US007570277B2

(12) United States Patent
Ikeda

(10) Patent No.: US 7,570,277 B2
(45) Date of Patent: Aug. 4, 2009

(54) ELECTROLUMINESCENCE DISPLAY DEVICE

(75) Inventor: Kyoji Ikeda, Gifu-Pref (JP)

(73) Assignee: Sanyo Electric Co., Ltd. (JP)

( * ) Notice: Subject to any disclaimer, the term of this patent is extended or adjusted under 35 U.S.C. 154(b) by 595 days.

(21) Appl. No.: 11/454,960

(22) Filed: Jun. 15, 2006

(65) Prior Publication Data

US 2006/0284803 A1 Dec. 21, 2006

(30) Foreign Application Priority Data

Jun. 20, 2005 (JP) ..... 2005-179083
Jun. 2, 2006 (JP) ..... 2006-154839

(51) Int. Cl.
*G09G 5/10* (2006.01)
*G09G 3/30* (2006.01)
*G09G 3/10* (2006.01)
*H01J 1/62* (2006.01)

(52) U.S. Cl. ..... 345/690; 345/76; 315/169.3; 313/505

(58) Field of Classification Search ..... 345/76, 345/204, 211; 315/169.1, 169.3, 169.4; 313/505, 313/506; 257/88, 93
See application file for complete search history.

(56) References Cited

U.S. PATENT DOCUMENTS 6,531,815 B1 3/2003 Okuyama et al.
6,611,108 B2 * 8/2003 Kimura ..... 315/169.3
6,867,541 B2 3/2005 Okuyama et al.
7,190,122 B2 * 3/2007 Winters et al. ..... 315/169.1
7,333,077 B2 * 2/2008 Koyama et al. ..... 345/76
2005/0180083 A1 * 8/2005 Takahara et al. ..... 361/152

OTHER PUBLICATIONS

Japanese Patent Laid-Open Publication No. 2001-102169 with its English abstract.

* cited by examiner

*Primary Examiner*—Kent Chang
*Assistant Examiner*—Ilana Spar
(74) *Attorney, Agent, or Firm*—Cantor Colburn LLP

(57) ABSTRACT

A display portion in which pixels are arranged in a matrix is formed on a display panel and a drive current line, which supplies a drive current from a terminal formed at a side along a column direction to a display element in each pixel, includes a branch line provided for each column of the display portion and along each column of the display portion; a trunk line to which the branch line is connected and which extends along a row direction at a peripheral portion at a lower side of the display portion; and a connection line which connects the trunk line and the terminal. The connection line is separated from a region of the trunk line near the terminal by a slit provided from a side of the trunk line near the terminal to a side of the trunk line distanced from the terminal and extends in parallel to the region of the trunk line near the terminal at the peripheral portion at the lower side of the display portion from a region in which the terminal is formed. The connection line is connected to the trunk line at an intermediate position of the peripheral portion at the lower side of the display portion along the row direction. A length of the slit and a width of the region of the trunk line near the terminal are optimized to inhibit brightness variation within the display portion.

8 Claims, 9 Drawing Sheets

ELECTROLUMINESCENCE DISPLAY DEVICE

CROSS-REFERENCE TO RELATED APPLICATIONS

The entire disclosure of Japanese Patent Application Nos. 2005-179083 and 2006-154839 including specification, claims, drawings, and abstract is incorporated herein by reference.

BACKGROUND OF THE INVENTION

1. Field of the Invention

The present invention relates to a line in a display device which uses a current-driven element, such as, for example, an organic electroluminescence element (hereinafter referred to as "organic EL element"), as a display element in each pixel.

2. Description of the Related Art

Display devices which use current-driven organic electroluminescence (EL) elements as a display element in each pixel are known and, in particular, active matrix display devices in which a transistor (thin film transistor or "TFT") is provided in each pixel for individually driving, for each pixel, the organic EL element provided in each pixel are now a focus of development.

FIG. 1 exemplifies an equivalent circuit corresponding to a pixel in an active matrix display device. A gate line GL is provided along a horizontal scan direction (row direction) of the display device and a data line DL and a power supply line PL are provided along a vertical scan direction (column direction) of the display device. Each pixel comprises a selection transistor Ts which is an n-channel TFT, a storage capacitor Cs, a p-channel element driving transistor Td, and an organic EL element EL. The selection transistor Ts has a drain connected to a common data line DL which supplies a data voltage to pixels positioned along the vertical scan direction, a gate connected to a gate line GL for selecting pixels positioned along the horizontal scan direction, and a source connected to a gate of the element driving transistor Td.

The element driving transistor Td is a p-channel TFT and has a source connected to the power supply line PL and a drain connected to an anode of the organic EL element EL. A cathode of the organic EL element EL is connected to a cathode power supply CV which is formed common to the pixels. One electrode of the storage capacitor Cs is connected between the gate of the element driving transistor Td and the source of the selection transistor Ts. The other electrode of the storage capacitor Cs is connected to a power supply of a constant voltage such as, for example, ground and a power supply line.

In this circuit, when the gate line GL is set to the H level, the selection transistor Ts is switched on, a data voltage on the data line DL is supplied via the selection transistor Ts to the gate of the element driving transistor Td, the element driving transistor Td allows a drive current corresponding to the gate voltage of the element driving transistor Td to flow from the power supply line PL through the element driving transistor Td, and light is emitted from the organic EL element EL at an intensity corresponding to the drive current. The data voltage on the data line DL is supplied to the storage capacitor Cs in addition to the element driving transistor Td and a voltage corresponding to the data voltage is stored in the storage capacitor Cs. Therefore, even when the gate line GL is set to an L level, the element driving transistor Td continues to supply the drive current according to the voltage stored in the storage capacitor Cs, and, thus, the organic EL element EL continues to emit light at an intensity corresponding to the drive current.

FIG. 2 is a plan view schematically showing an organic EL display device 100 disclosed in Japanese Patent Laid-Open Publication No. 2001-102169 (hereinafter referred to as "Reference 1"). In FIG. 2, the outermost solid line represents a transparent panel substrate 102 and a display region 104, shown by a dotted line and in which the above-described pixels are arranged in a matrix form, is positioned at a position slightly above the center of the panel substrate 102. A horizontal driver circuit 106 (hereinafter referred to as "H-related driver") which is connected to the data line DL is formed along an upper side of the display region 104 and vertical driver circuits 108 (hereinafter referred to as "V-related driver") which are connected to the gate lines GL are formed along the right and left sides of the display region 104. These drivers 106 and 108 comprise TFT or the like which is formed simultaneously with the TFTs provided in each pixel.

The thick solid line extending in the display region 104 along the vertical direction indicates the power supply line PL. Individual power supply line PL is connected to a wide portion 110 in the horizontal direction which extends along the lower side of the display region 104 and forms a comb shape as a whole. The wide portion 110 is further connected, near the center of the wide portion 110, to another wide portion 112 extending along the vertical direction. The wide portion 112 is connected to an input terminal T1 for the drive power supply placed at the lower side of the organic EL display device 110. Because the wide portion 112 in the vertical direction is connected to the wide portion 110 in the horizontal direction near the center of the wide portion 110, potential drops in the pixels near the left and right sides of the display region are balanced and the amount of potential drop can be reduced. In other words, variation in the potential among the pixels can be inhibited.

On the lower side of the organic EL display device 100, a plurality of terminals including a cathode terminal T2, a terminal T3 connected to the V-related driver 108, and a terminal T4 connected to the H-related driver 106 are placed in addition to the terminal T1.

In the organic EL display devices of the related art, the terminals for external connection are provided on the lower side of the panel substrate as described in the above-described Reference 1. There is, however, a demand that the terminals be placed on the right side or on the left side in relation to devices other than the display device. On the other hand, normally, because the demand for reducing the manufacturing cost is very strong, a change in layout on the panel substrate 100, such as the circuit structure and driver in the display region 104, is minimized. This is because the change of layout or the like may involve a change of masks which are used for forming the element and line and re-examination of the characteristics, which result in significant increase in cost. Therefore, when the input terminal for the drive power supply is placed at one end (left side) along the horizontal scan direction, for example, connecting the terminal and the portion of the wide portion extending along the horizontal direction in a minimum distance maybe considered. However, because all power supply lines PL are connected to the wide portion 110 and supply current to the EL elements in the pixels, when the terminal and the left side of the wide portion in the horizontal direction are connected, a large current flows through the wide portion, resulting in a larger potential drop towards the right side along the horizontal scan direction distanced from the terminal. Thus, the potential on the left side of the display region and the potential on the right side of the display region would significantly differ from each other. Such a difference in potential leads to a potential difference in corresponding power supply lines PL, resulting in different currents flowing through the organic EL elements depending on the position of the organic EL element on the panel, which is in turn recognized as a difference in the light emission intensity of the organic EL element and degradation of the display quality.

SUMMARY OF THE INVENTION

The present invention advantageously reduces variation in brightness on a display screen when the drive current for the organic EL element is supplied from a left or right side of the organic EL display device.

According to one aspect of the present invention, there is provided an electroluminescence display device having, on a display panel, a display portion in which pixels are arranged in a matrix, wherein a drive current line which supplies a drive current from a terminal positioned at a side of the display panel along a column direction to a display element in each pixel comprises a branch line provided for each column of the display portion and along each column of the display portion, a trunk line to which the branch line is commonly connected and which extends along a row direction of the display portion at a peripheral portion at a lower side of the display portion, and a connection line which connects the trunk line and the terminal. The connection line is separated from the region of the trunk line near the terminal by a slit which is provided from a region of the trunk line near the terminal toward a region of the trunk line distanced from the terminal, and extends in parallel to the region of the trunk line near the terminal from a region in which the terminal is formed to the peripheral portion at the lower side of the display portion, and the trunk line and the connection line are connected to each other at an intermediate position along the row direction of the peripheral portion at the lower side of the display portion.

According to another aspect of the present invention, it is preferable that, in the electroluminescence display device, the connection line and the trunk line form a drive current line region provided in the peripheral portion at the lower side of the display portion, extending along the row direction, and having an approximately rectangular external shape, the slit is formed along the row direction from a side of the approximately rectangular external shape near the terminal, and, when a length of the slit is X, a length in the drive current line region from an end of the slit to a side of the approximately rectangular external shape distanced from the terminal is Y, a width of the drive current line region along the column direction is W, and a width, along the column direction, of the region of the trunk line near the terminal placed separated from the connection line by the slit is L, $0<X<Y$, $0<L<W$, and $X/Y=\sqrt{L}/\sqrt{W}$.

According to another aspect of the present invention, it is preferable that, in the electroluminescence display device, the length of the slit is determined such that a light emission brightness in each pixel of the display portion is a brightness of 70% or greater or 80% or greater with respect to a maximum light emission brightness.

According to another aspect of the present invention, it is preferable that, in the electroluminescence display device, the width of the branch line is determined based on a color associated to the pixel, and at least two types of branch lines having different widths are present.

According to another aspect of the present invention, there is provided an electroluminescence display device having, on a display panel, a display portion in which pixels are arranged in a matrix, wherein a drive current line which supplies a drive current from a terminal positioned on a side of the display panel along a column direction to a display element in each pixel comprises a branch line provided for each column of the display portion and along each column of the display portion, a trunk line to which the branch line is commonly connected and which extends along a row direction of the display portion at a peripheral portion at a lower side of the display portion, and a connection line which connects the branch line and the terminal. The connection line extends from a region in which the terminal is formed to the peripheral portion at the lower side of the display portion in which the trunk line is formed and overlaps the trunk line with an insulating layer therebetween at least in a region in which the connection line overlaps a region in which the trunk line is formed, and the connection line is connected to the trunk line through a contact hole formed through the insulating layer at a center portion of the trunk line along the row direction.

With this structure, an intermediate position, along the horizontal scan direction, of the trunk line, which is provided along the horizontal scan direction of the display region, is connected to the common connection line from the external connection terminal instead of a position on the trunk line closest to the external connection terminal. Thus, a uniform drive current can be supplied to pixels at any position along the horizontal scan direction regardless of a distance from the external terminal; variation in the potential drop on the drive line in the display region, in particular, a difference in the potential drop along the horizontal scan direction, can be reduced; and potential drop itself can be reduced. In this manner, difference in light emission intensities among pixels at right and left positions in the display region can be minimized.

BRIEF DESCRIPTION OF THE DRAWINGS

Preferred embodiments of the present invention will be described in detail by reference to the drawings, wherein.

DESCRIPTION OF THE PREFERRED EMBODIMENTS

Figure 1:
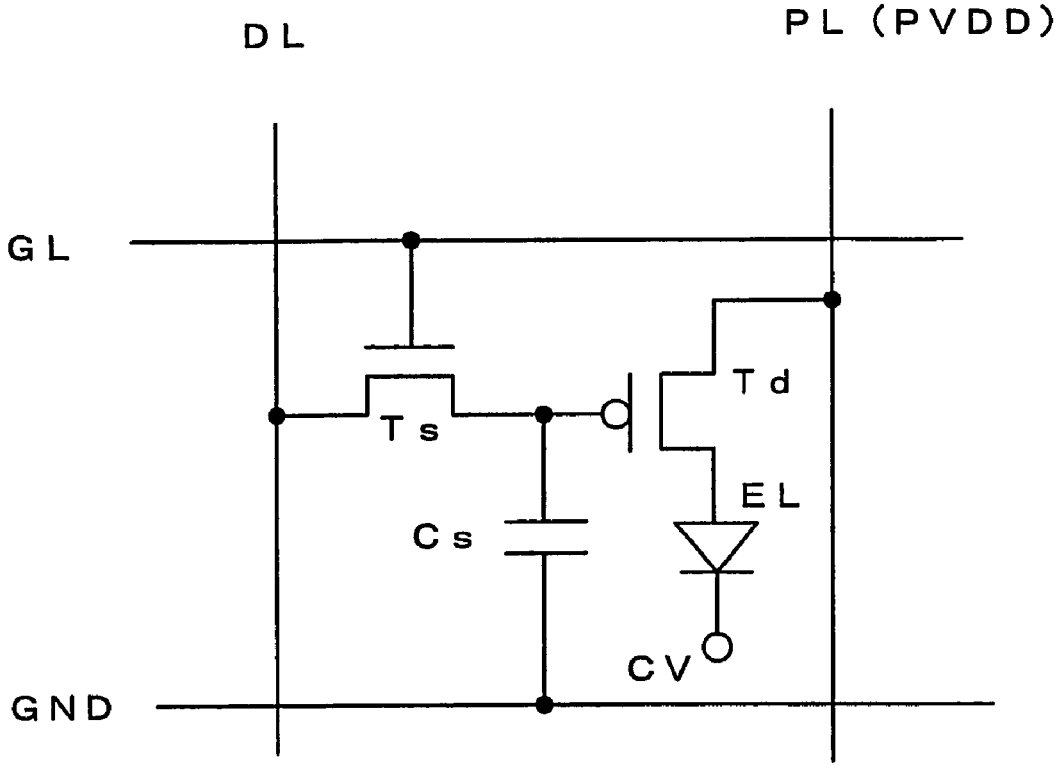
Fig. 1 Prior Art
FIG. 1 is a diagram showing an equivalent circuit of a pixel of an active matrix display device.
Figure 2:
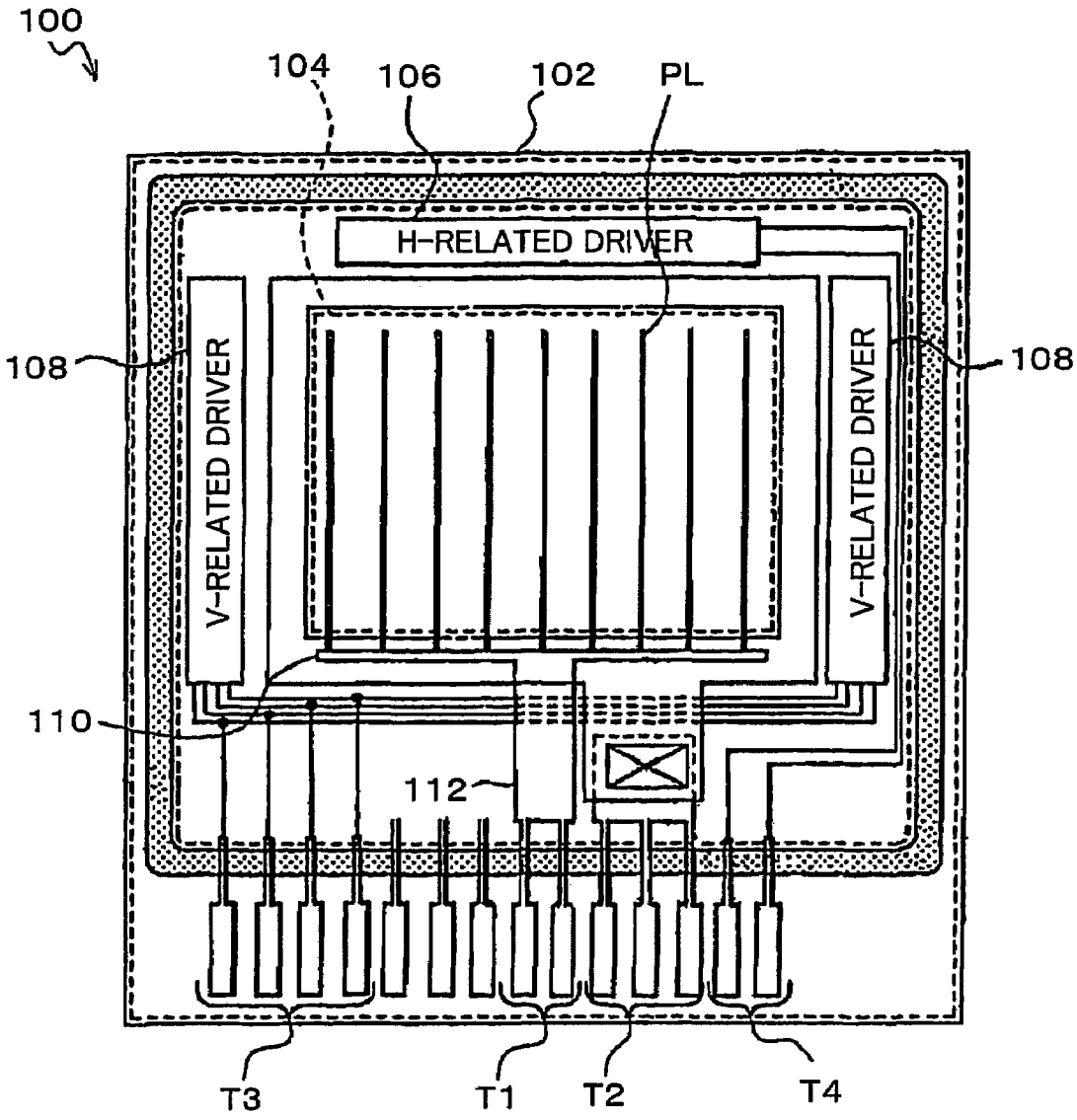
Fig. 2 Prior Art
FIG. 2 is a diagram schematically showing a layout of an organic EL display panel in related art.
Figure 3:
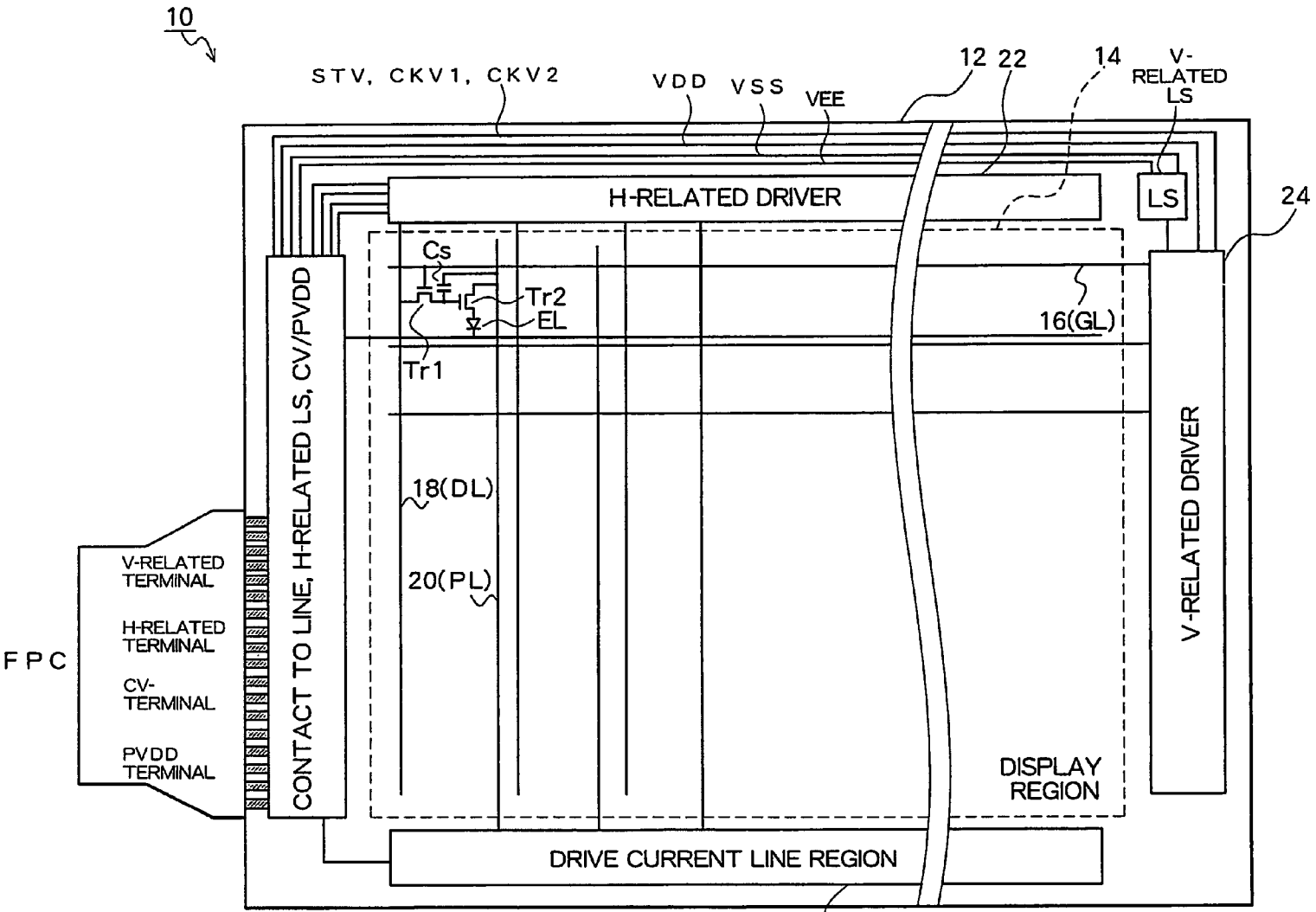
FIG. 3 is a diagram schematically showing a panel layout of an organic EL display device according to a preferred embodiment of the present invention.

Preferred embodiments of the present invention will now be described referring to the drawings. FIG. 3 is a diagram schematically showing a panel layout of a display portion, circuits, and a line in an organic EL display device 10 according to a preferred embodiment of the present invention. A display region 14 is formed on a panel substrate 12 with a plurality of pixels arranged in a matrix form. In the display region 14 of the panel substrate 12, a gate line 16 (GL) to which a selection signal is sequentially output is formed along a horizontal scan (row) direction of the matrix and a data line 18 (DL) to which a data signal is output and a power supply line 20 (PL) for supplying a drive current from an operational power supply (PVDD) to an organic EL element which is an element to be driven are formed along a vertical scan (column) direction.

Each pixel is approximately provided at a region defined by these lines and comprises, as circuit elements, an organic EL element which is an element to be driven, a selection transistor Tr1 which is an n-channel TFT, a storage capacitor Cs, and an element driving transistor Tr2 which is a p-channel TFT. The selection transistor Tr1 has a drain connected to a data line 18 for supplying a data voltage to the pixels along the vertical scan direction, a gate connected to a gate line 16 for selecting pixels along a horizontal scan line, and a source connected to a gate of the element driving transistor Tr2. The element driving transistor Tr2 has a source connected to a power supply line 20 and a drain connected to a pixel electrode which forms an anode of the organic EL element EL and which is formed in an individual pattern for each pixel in the present embodiment. A cathode of the organic EL element EL is formed common to the pixels and is connected to a cathode power supply CV. A first electrode of the storage capacitor Cs is connected to the gate of the element driving transistor Tr2 and the source of the selection transistor Tr1 and a second electrode of the storage capacitor Cs which is the other electrode is connected to a constant potential such as, for example, the power supply line 20.

The selection transistor Tr1 and the element driving transistor Tr2 can be formed using an n-channel thin film transistor TFT or a p-channel thin film transistor TFT in which a crystalline silicon such as, for example, polycrystalline silicon polycrystallized by laser annealing or the like is used in an active layer and an n-type conductive impurity or a p-type conductive impurity is doped as the impurity. The structure of the pixel circuit and the conductive type of the TFT in the present invention are not limited to the above-described configuration, and other configurations may be employed.

When a TFT having crystalline silicon in the active layer is employed as the transistor of the pixel circuit, the crystalline silicon TFT can be used as a circuit element in a peripheral driver circuit for sequentially selecting and controlling each pixel, in addition to use as a circuit element in the pixel circuit. In the organic EL display device 10 of the present embodiment, a crystalline silicon TFT similar to that in the pixel circuit is formed on the panel substrate 12 simultaneously with the manufacturing of the transistors for the pixel circuit so that the peripheral driver circuit, more specifically, an H-related driver 22 and a V-related driver 24, are built in. As shown in FIG. 3, the H-related driver 22 is provided along the upper side of the display region 14 and the V-related driver 24 is placed along the right side of the display region 14.

A drive current line for supplying the drive current to each pixel from the drive power supply PVDD is formed in a drive current line region 26 along the lower side of the display region 14. Connection terminals for flat panel cables (hereinafter referred to as "FPC") for supplying control signals and power to the H-related driver 22 and V-related driver 24 from outside of the organic EL display device 10 are placed on the left side of the panel substrate 12. A connection terminal to the FPC and an H-related level shifter LS for connecting the H-related driver 22 and V-related driver 24 with the drive current line or for converting the supplied potential to a potential suitable for the operation of the H-related driver 22 are placed along the left side of the display region 14. The connection terminal with the FPC is preferably placed at a position lower than a center in the height direction of the display region. In addition, a V-related level shifter LS for converting a supplied potential to a potential suitable for the operation of the V-related driver 24 is provided on an upper right corner of the display region 14.

Figure 4:
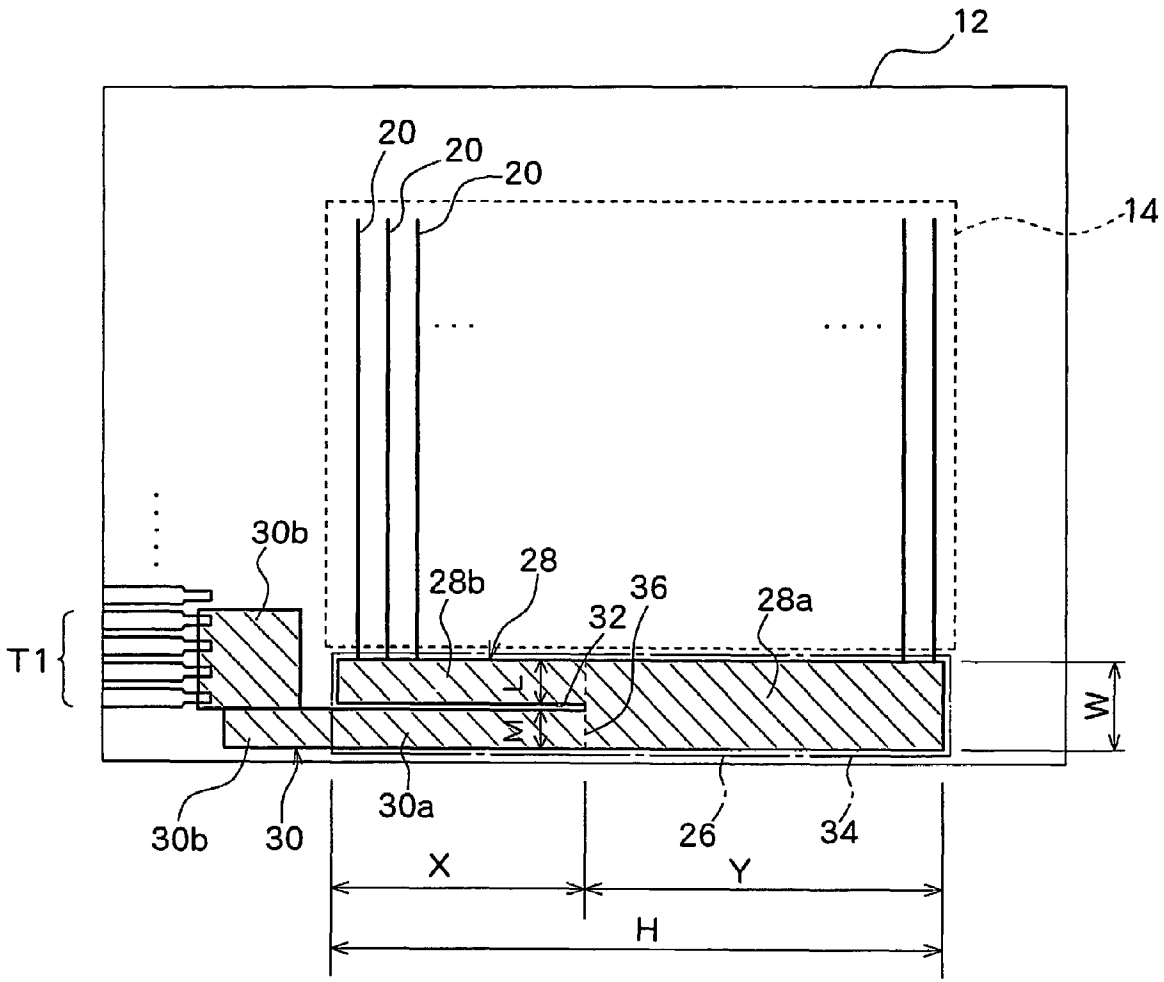
FIG. 4 is a diagram conceptually showing a drive power supply line of the organic EL display device.

FIG. 4 shows a detailed structure of a drive current line (PVDD line) for supplying a drive current to the organic EL element EL of each pixel. The drive current line comprises a branch line extending along each column of the matrix in the display portion, a trunk line to which each branch line is connected and which is provided extending along a row direction (horizontal scan direction) of the display portion at a periphery of the display portion at the lower side of the panel substrate 12, and a connection line which connects the trunk line and the connection terminal T1 for external power supply.

The branch line is the power supply line 20 as described above, and the power supply line 20 will hereinafter be referred to as the branch line 20. A trunk line 28 is positioned in the drive current line region 26 and has a line width different along the horizontal scan direction (on the left and right of the display region). A right portion 28*a* of the trunk line 28 is provided at a position distanced from the terminal T1 than is the center of the panel in the horizontal scan direction (a position near a side which is opposite to the side on which the terminal T1 is formed) and has a line width (size along the vertical scan direction) of W mm. Unlike the right portion 28*a*, a left portion 28*b* of the trunk line 28 is provided at a position near the terminal T1 than is the center of the panel in the horizontal scan direction (a position near the side on which the terminal T1 is formed) and has a line width of L mm (wherein $0<L<W$).

The connection line 30 is a common line for uniformly connecting the external connection terminal T1 to the left and right portions 28*a* and 28*b* of the branch line 28 and has a parallel placement portion 30*a* which is placed in parallel to the left side 28*b* of the trunk line and a connection portion 30*b* connecting the parallel placement portion 30*a* and the connection terminal T1. A slit 32 is formed between the left portion 28*b* of the trunk line and the parallel placement portion 30*a* of the connection line so that these lines are separated. The external shape of the trunk line 28 and the parallel placement portion 30*a* of the connection line is a rectangle 34 shown by a dot-and-chain line.

In other words, by providing the slit 32 in the line of the rectangle 34 (drive current line region 26), the trunk line 28 and the parallel placement portion 30*a* of the connection line are formed. That is, the slit 32 is formed from an edge of the rectangular drive current line region near the terminal T1 toward a center direction of the horizontal scan direction (direction departing from the terminal Ti) and has a function to elongate the line length between the terminal Ti and a region of the trunk line 28 near the terminal (left portion 28*b* ). With the slit 32, it is easy to set the line length between the region of the trunk line 28 in the region near the terminal (left portion 28*b* ) and the terminal T1 and the line length between the region of the trunk line 28 in a region distanced from the terminal (right portion 28*a*) and the terminal T1 to be approximately equivalent.

By providing the slit 32 in the drive current line region in this manner, a position from which the current is supplied to the trunk line 28 (hereinafter referred to as a connection portion (connection point) 36) becomes the tip position of the slit 32, the current is split to right and left at the tip position, and, thus, the potential on the left and right along the horizontal scan direction can be easily balanced. Although the branch line 20, right portion 28*a* of the trunk line 28, left portion 28*b* of the trunk line 28, and parallel placement portion 30*a* are shown in separate areas in the drawings for ease of explanation, in reality, these line and regions can be integrally formed using a conductive metal line material such as aluminum.

A condition for equating the potential drops at the right and left of the trunk line 28 from the connection portion 36 will now be calculated. When the width of the right portion 28*a* of the trunk line is W mm, the length of the right portion 28*a* is Y mm, the width of the left portion 28*b* of the trunk line is L mm, and the length of the left portion 28*b* is X mm, the overall length of the trunk line is H mm (H=X+Y), the width of the parallel placement portion 30*a* is M mm (M=W−L), and the length of the parallel placement portion 30*a* is X mm. The length X of the left portion 28*b* and of the parallel placement portion 30*a* is also the length of the slit 32. When the sheet resistance of the line material is ρ and the overall current flowing through the drive power supply line is I, the potential drop ΔVr of the right portion 28, which is a sum of ½ of the resistance on the right portion and a sum of current of the right portion, is $$\Delta Vr=(1/2)\rho(Y/W)*Y/(X+Y)*I \quad (1)$$

Similarly, the potential drop ΔVl of the left portion 28*b* is $$\Delta Vl=(1/2)\pi(X/L)*X/(X+Y)*I \quad (2)$$

The potential drop can be minimized when the potential drops on the right and left of the connection portion 36 are equal. This condition corresponds to ΔVr=ΔVl, and, thus, from equations 1 and 2, the condition is:

$$X/Y=\sqrt{L}/\sqrt{W} \quad (3)$$

In the equation, 0<X<Y and 0<L<W.

Figure 5:
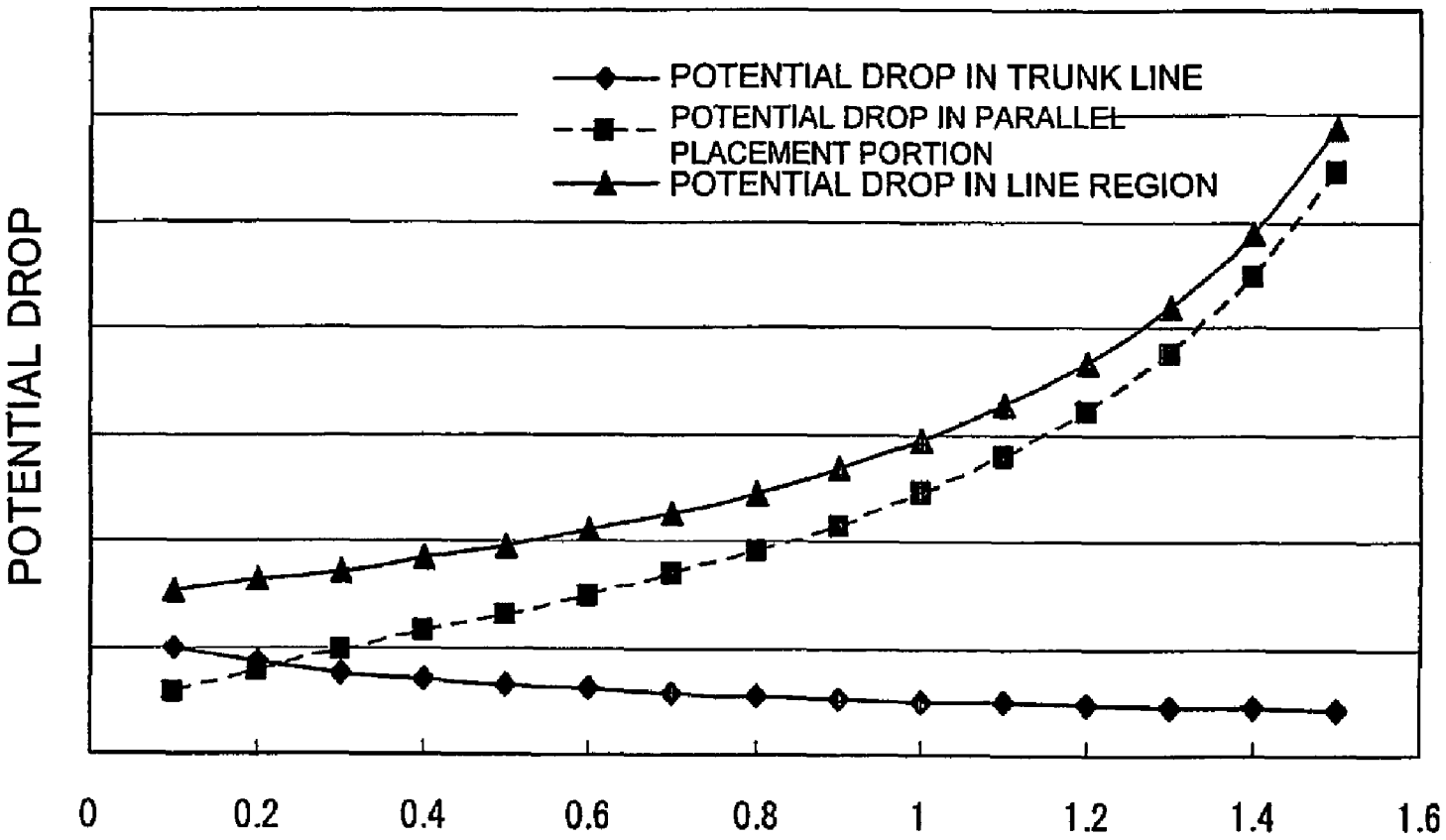
FIG. 5 is a diagram showing a dependency of a potential drop on a width L.

FIG. 5 is a diagram showing a potential drop in the drive current line region 26 where H=50.9 mm, W=2 mm, L=0.1−1.5 mm, ρ=0.077 (Ω/□), and I=169 mA. The graph of the potential drops of the trunk line shows the potential drops of the region 28*a* distanced from the terminal which is at the right of the connection portion 36 at the tip of the slit (right portion 28*a*) and of the region 28*b* near the terminal which is at the left of the connection portion 36 (left portion 28*b*). The potential drop is reduced as the width L of the left portion is increased. On the other hand, the graph of the potential drop of the parallel placement portion shows the potential drop at the parallel placement portion 30*a* of the connection line. The potential drop at the parallel placement portion 30*a* is increased as the width L is increased. The graph of the potential drop of the line region is created by adding potential drops of the two graphs and shows the total potential drop from the left end of the parallel placement portion 30*a* to the right end or the left end of the trunk line 28.

When the potential drop in the line region is large, the brightness of the entire display region is reduced and sufficient screen brightness cannot be obtained. From this point of view, the width L is preferably narrow, that is, the slit length X is preferably short. On the other hand, when the potential drop of the trunk line is large, a difference in brightness of pixel at a position near the connection portion 36 (near the center on the horizontal scan direction) and the pixels at the left and right ends of the display region becomes large, resulting in a variation in brightness which is recognized by the viewer. Therefore, from this point of view, the width L is preferably wide. Thus, it is desirable that the width L is as small as possible, that is, the slit is as short as possible, in a range in which the minimum brightness with respect to the maximum brightness is acceptable. When the minimum brightness is in a range of approximately 80% of the maximum brightness, the difference in brightness tends not to be recognized as the brightness variation, and such a display device would be evaluated as having a high display quality. Therefore, it is preferable to use a minimum value of the width L that satisfies this condition. When the overall brightness of the panel is not sufficient because the potential drop in the line region is large when the width L (slit length X) is set in this manner, the width L may alternatively be set so that the variation in the brightness is approximately 70% which is an acceptable range.

Figure 6:
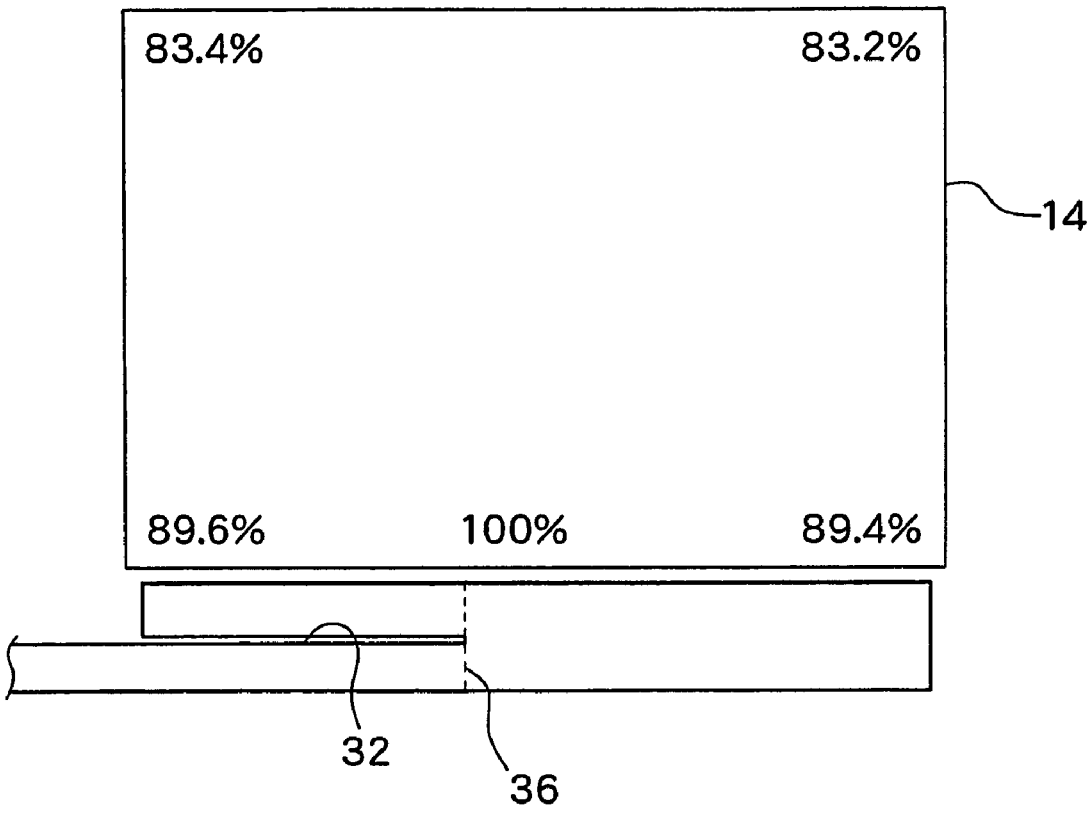
FIG. 6 is a diagram showing a brightness ratio of four corner pixels in a relative manner in the organic EL display device.

FIG. 6 shows brightness ratios among pixels positioned at four corners of the display region 14 when H=50.9 mm, W=2 mm, L=1 mm, ρ=0.077 (Ω/□), I=169 mA, and width of the branch line 20 equals 12 μm. In FIG. 6, the brightness ratios of the pixels at four corners are shown with respect to the brightness of the pixel at the tip of the slit 32 (100%), that is, the pixel near the connection portion 36 and at the center of the lower side of the display region. As shown in FIG. 6, all of the brightness ratios of four corner pixels exceed 80%, and, thus, the panel is evaluated as a panel having a small brightness variation. When the brightness ratio is less than 70%, the lower brightness tends to be recognized as a variation in brightness. As such, use of this condition is preferably avoided. In the above-described example configuration, the brightness of the upper right and upper left pixels of the display region 14 having the longest electrical line distance from the terminal T1 is 83.2% or greater with respect to the maximum brightness of 100%, and, thus, it can be seen that there is still a sufficient margin even when a partial reduction of the light emission intensity due to variation among products is considered. In addition, it can be seen that the width W of the line can be narrowed.

Figure 7:
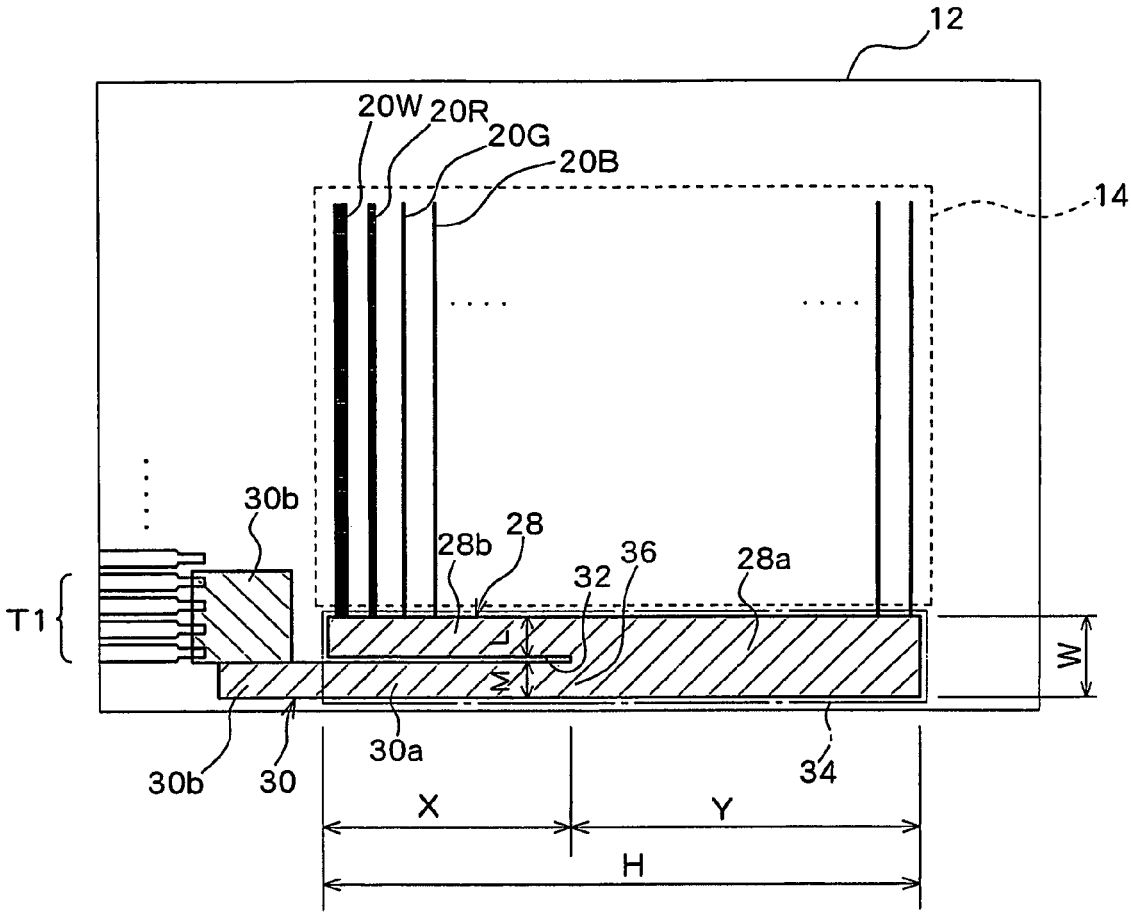
FIG. 7 is a diagram exemplifying a display device in which the width of a branch line is set separately for each color.

FIG. 7 shows an example configuration in which different widths are set to branch lines corresponding to different colors of pixels. This is because the current to be supplied differs depending on the color of the pixel, and, thus, a wider line is employed for pixels that require a larger current. Specifically, in an organic EL element employing different light emitting materials to emit light of different colors, because the light emission efficiency differs depending on the material, a larger current must be supplied to an organic EL element of the color having a lower light emission efficiency, in order to achieve similar brightness as the other colors. When a full-color display is realized using the same light emitting material for all pixels and a color changing member such as a color filter, although the light emission efficiency is equal in all pixels, there is a demand for changing the light emission brightness depending on the corresponding color, because of a feeling of color by humans, display image, and standard of the image. The example configuration of FIG. 7 can be employed to satisfy these demands, and, in the example configuration of FIG. 7, the width of the branch line 20W which supplies the drive current to white pixels is the largest, the width of the branch line 20R for red is the second largest, and the widths of the branch lines 20G and 20B for green and blue, respectively, are the smallest. The other structures are identical to those in the drive current line shown in FIG. 4 and will not be described again. In the example configuration of FIG. 7, lines of three different widths are employed. The present invention, however, is not limited to such a configuration, and lines of two different widths may be employed or all lines may have different widths from each other. Moreover, the relationship among the widths of the branch lines of the colors is not limited to that described above, and suitable widths may be employed for the widths of the branch lines of colors which are necessary depending on the structure.

Figure 8:
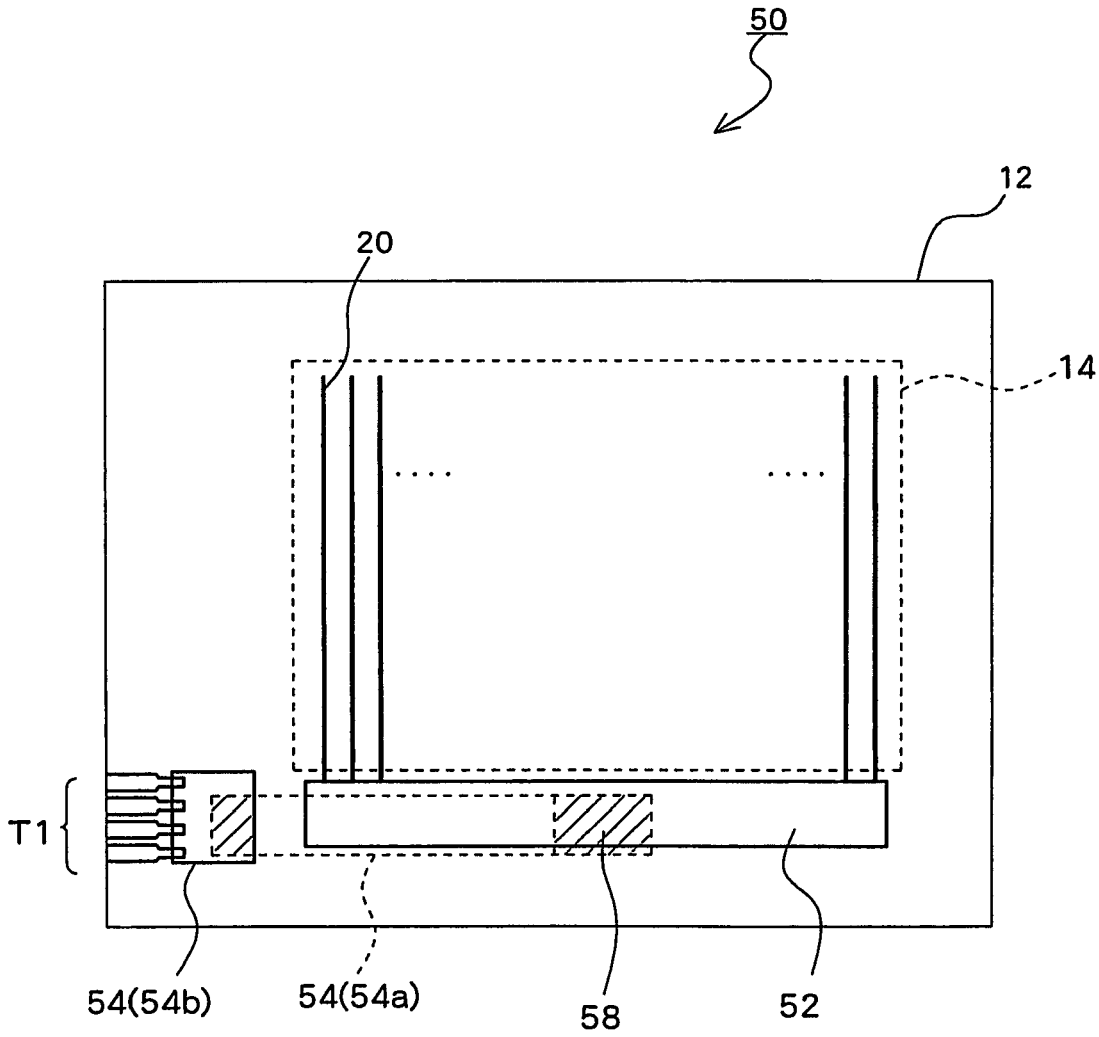
FIG. 8 is a diagram schematically showing a panel layout of an organic EL display device according to another preferred embodiment of the present invention.
Figure 9:
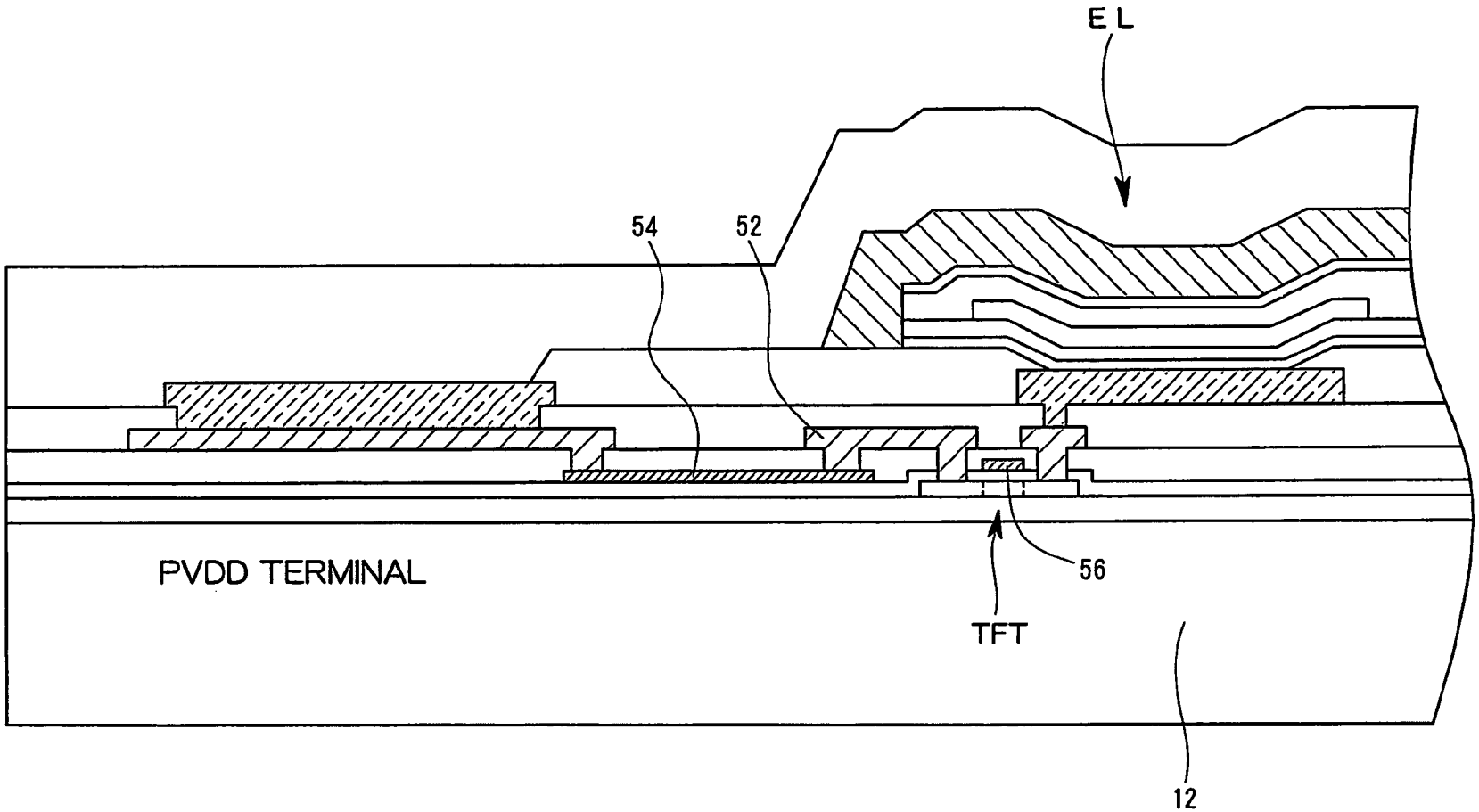
FIG. 9 is diagram showing a cross section of the organic EL display device.

FIGS. 8 and 9 are a plan view and a cross sectional view showing an important portion of an organic EL display device 50 according to another preferred embodiment of the present invention. The organic EL display device 50 differs from the organic EL display device 10 in the structure of the trunk line and the connection line. The other structures are identical to those of the organic EL display device 10 and will not be described again.

A trunk line 52 extends along the horizontal scan direction outside of the display region 14 at a constant width and the connection line 54 is formed using a conductive layer which is insulated and differs from the trunk line 52 at least in a region in which the connection line 54 overlaps the trunk line 52 in the plan view. For example, as shown in FIG. 9, a line layer in which a metal line material identical to that for the gate electrode 56 of the TFT such as the selection transistor Tr1 and the element driving transistor Tr2 is used and which is formed simultaneously with the gate electrode 56 can be used for the connection line 54. The line material of the gate electrode may be, for example, a refractory metal such as Cr and Mo. The trunk line 52 and the branch line 20, on the other hand, can be formed simultaneously with the data line or the like using a line material such as aluminum identical to that of the data line or the like. In the present embodiment, the connection line 54 comprises a bridging portion 54*a* which is formed in a different layer than the trunk line 52 and a connection portion 54*b* formed in the same layer as the trunk line 52 and connected to the external terminal T1. The trunk line 52 and the bridging portion 54*a* are connected to each other through a contact hole formed through the insulating layer between the layers (in the configuration of FIG. 9, interlayer insulating layer) at a portion 58 of the central portion of the trunk line 52 shown by a dotted line. The lengths of the trunk line 52 extending from the connection portion 58 to the left and right ends of the display region 14 are approximately identical and, thus, the potential drops on the left and right ends of the display region 14 are almost identical, and the difference in the potential of the power supply among the pixels can be minimized.

Also in the structure of the power supply line of FIGS. 8 and 9, it is possible to employ a structure in which the widths of the branch lines differ depending on the color as exemplified in FIG. 7.

What is claimed is:

1. An electroluminescence display device having, on a display panel, a display portion in which pixels are arranged in a matrix, wherein a drive current line which supplies a drive current from a terminal positioned at a side of the display panel along a column direction to a display element in each pixel comprises:

a branch line provided for each column of the display portion and along each column of the display portion;

a trunk line to which the branch line is commonly connected and which extends along a row direction of the display portion at a peripheral portion at a lower side of the display portion; and a connection line which connects the trunk line and the terminal, wherein the connection line is separated, by a slit which is provided from a region of the trunk line near the terminal toward a region of the trunk line distanced from the terminal, from the region of the trunk line near the terminal and extends in parallel to the region of the trunk line near the terminal from a region in which the terminal is formed to the peripheral portion at the lower side of the display portion, and the trunk line and the connection line are connected to each other at an intermediate position along the row direction of the peripheral portion at the lower side of the display portion.

2. An electroluminescence display device according to claim 1, wherein the connection line and the trunk line form a drive current line region provided in the peripheral portion at the lower side of the display portion, extending along the row direction, and having an approximately rectangular external shape, the slit is formed along the row direction from a side of the approximately rectangular external shape near the terminal, and when a length of the slit is X, a length in the drive current line region from an end of the slit to a side of the approximately rectangular external shape distanced from the terminal is Y, a width of the drive current line region along the column direction is W, and a width, along the column direction, of the region of the trunk line near the terminal placed separated from the connection line by the slit is L, $0<X<Y$ and $0<L<W$, and $X/Y=\sqrt{L}/\sqrt{W}$.

3. An electroluminescence display device according to claim 2, wherein a width of the branch line is determined based on a color associated to the pixel, and at least two types of branch lines having different widths are present.

4. An electroluminescence display device according to claim 2, wherein the length of the slit is determined such that a light emission brightness in each pixel of the display portion is a brightness of 70% or greater with respect to a maximum light emission brightness.

5. An electroluminescence display device according to claim 4, wherein the length of the slit is determined such that the light emission brightness in each pixel of the display portion is a brightness of 80% or greater with respect to the maximum light emission brightness.

6. An electroluminescence display device according to claim 1, wherein a width of the branch line is determined based on a color associated to the pixel, and at least two types of branch lines having different widths are present.

7. An electroluminescence display device having, on a display panel, a display portion in which pixels are arranged in a matrix, wherein a drive current line which supplies a drive current from a terminal positioned at a side of the display panel along a column direction to a display element in each pixel comprises:

a branch line provided for each column of the display portion and along each column of the display portion;

a trunk line to which the branch line is commonly connected and which extends along a row direction of the display portion at a peripheral portion at a lower side of the display portion; and a connection line which connects the trunk line and the terminal, wherein the connection line extends from a region in which the terminal is formed to the peripheral portion at the lower side of the display portion in which the trunk line is formed and overlaps the trunk line with an insulating layer therebetween at least in a region in which the connection line overlaps a region in which the trunk line is formed, and the connection line is connected to the trunk line through a contact hole formed through the insulating layer at a center portion of the trunk line along the row direction.

8. An electroluminescence display device according to claim 7, wherein a width of the branch line is determined based on a color associated to the pixel, and at least two types of branch lines having different widths are present.

* * * * *